US008155366B2

(12) United States Patent
Baumhauer, Jr. et al.

(10) Patent No.: US 8,155,366 B2
(45) Date of Patent: Apr. 10, 2012

(54) TRANSDUCER PACKAGE WITH INTERIOR SUPPORT FRAME

(75) Inventors: John Charles Baumhauer, Jr., Indianapolis, IN (US); Alan Dean Michel, Fishers, IN (US); Joshua R. Barber, New Castle, IN (US); Christopher Todd Welsh, Fishers, IN (US); Jeffrey Phillip McAteer, Carmel, IN (US)

(73) Assignee: MWM Acoustics, LLC, Indianapolis, IN (US)

( * ) Notice: Subject to any disclaimer, the term of this patent is extended or adjusted under 35 U.S.C. 154(b) by 427 days.

(21) Appl. No.: 12/456,188

(22) Filed: Jun. 12, 2009

(65) Prior Publication Data

US 2010/0290661 A1 Nov. 18, 2010

Related U.S. Application Data

(60) Provisional application No. 61/216,281, filed on May 15, 2009.

(51) Int. Cl.
*H04R 9/08* (2006.01)
*H04R 25/00* (2006.01)

(52) U.S. Cl. ..... 381/369; 381/175

(58) Field of Classification Search ..... 381/369, 381/170, 171, 174, 175
See application file for complete search history.

(56) References Cited

U.S. PATENT DOCUMENTS

| | | | | |
|---|---|---|---|---|
| 5,740,261 | A | 4/1998 | Loeppert et al. | |
| 6,781,231 | B2 | 8/2004 | Minervini | |
| 7,166,910 | B2 | 1/2007 | Minervini | |
| 7,242,089 | B2 | 7/2007 | Minervini | |
| 7,381,589 | B2 | 6/2008 | Minervini | |
| 7,434,305 | B2 | 10/2008 | Minervini | |
| 7,439,616 | B2 | 10/2008 | Minervini | |
| 7,940,944 | B2 * | 5/2011 | Song | 381/174 |

* cited by examiner

*Primary Examiner* — Brian Ensey
(74) *Attorney, Agent, or Firm* — Patent Law Office of David G. Beck

(57) ABSTRACT

A surface mountable package for use with an audio transducer is provided. In addition to the audio transducer, the surface mountable package includes a substrate, a cover, and a transducer support frame mounted within, and attached to, the substrate and cover. The support frame includes one or more cavities that, in combination with the audio transducer, substrate and cover, define the front and rear acoustic cavity volumes.

40 Claims, 5 Drawing Sheets

TRANSDUCER PACKAGE WITH INTERIOR SUPPORT FRAME

CROSS-REFERENCE TO RELATED APPLICATION

This application claims the benefit of the filing date of U.S. Provisional Patent Application Ser. No. 61/216,281, filed May 15, 2009, the disclosure of which is incorporated herein by reference for any and all purposes.

FIELD OF THE INVENTION

The present invention relates to a surface mountable package for an audio transducer such as, but not limited to, a silicon condenser microphone die or so called microelectromechanical system (MEMS) microphone. More particularly, this invention relates to a transducer package designed to maximize microphone sensitivity and electrical signal-to-noise ratio (SNR) performance.

BACKGROUND OF THE INVENTION

Miniature acoustic transducers, for example those fabricated using MEMS fabrication techniques, are used in a variety of applications such as stand-alone microphones, telephone handsets, cellular phones, hearing aids, and headsets. Typically such transducers, along with a microprocessor and interconnects, are mounted within a package that is designed to protect the transducer and associated components from manufacturing process extremes such as high temperature, handling and environmental damage, and electromagnetic interference in use, while providing a convenient means for mounting the device. Unfortunately, such transducer packages tend to be relatively complex due to the competing demands for an effective acoustic package that can also be fabricated in an efficient and cost effective manner.

Although there are a countless number of transducer package designs used in the industry, in general these packages include a substrate to which the transducer and associated components are mounted, and a protective cover attached to the substrate, the combination of which forms the transducer housing. Such a package, designed for use with a MEMS microphone, is disclosed in U.S. Pat. No. 6,781,231. In the disclosed MEMS package, the cover includes a conductive layer that, in at least one embodiment, is electrically connected to a conductive layer at least partially covering the substrate. The purpose of the conductive layers is to shield the MEMS microphone from external electromagnetic interference.

U.S. Pat. No. 7,166,910 discloses a silicon condenser microphone package that includes a transducer unit, a substrate, and a cover. In at least one disclosed embodiment, the substrate of the package is comprised of a printed circuit board with at least one conductive layer and at least one insulating layer. The cover also includes a conductive layer which, in concert with the conductive layer of the printed circuit board, provides an electromagnetic interference shield. When attached to the substrate, the transducer overlaps at least a portion of a recess formed in the substrate, thereby forming a back volume for the transducer within the substrate.

Although there are a variety of transducer package designs and techniques for fabricating the same, these designs and techniques tend to be relatively inflexible with respect to the acoustic aspects of the package. Accordingly, what is needed is a transducer package that achieves manufacturing simplicity while providing the package designer with increased design flexibility in terms of both acoustic performance and application configurations. The present invention provides such a design.

SUMMARY OF THE INVENTION

The present invention provides a surface mountable package for use with an audio transducer, the audio transducer being either a microphone transducer or a speaker transducer. In addition to the audio transducer, a transducer package in accordance with the invention includes three primary components; a substrate, a cover, and a transducer support frame mounted within, and attached to, the substrate and cover. The support frame defines both the front and rear acoustic cavity volumes.

In at least one embodiment of the invention, a transducer package is provided comprised of an audio transducer; a substrate that includes a plurality of contact pads on the lower substrate surface; a support frame with an audio transducer mounting flange, the support frame defining a first acoustic cavity volume in acoustic communication with an upper surface of the mounted audio transducer and a second acoustic cavity volume in acoustic communication with a lower surface of the mounted audio transducer; a cover attached to the substrate and support member; and an acoustic port in acoustic communication with the second acoustic cavity volume, wherein the substrate includes the acoustic port.

In at least one embodiment of the invention, a transducer package is provided comprised of an audio transducer; a substrate that includes a plurality of contact pads on the lower substrate surface; a support frame with an audio transducer mounting flange, the support frame defining a first acoustic cavity volume in acoustic communication with an upper surface of the mounted audio transducer and a second acoustic cavity volume in acoustic communication with a lower surface of the mounted audio transducer; and a cover attached to the substrate and support member, the cover including an acoustic port in acoustic communication with the first acoustic cavity volume. The transducer package may include at least one electronic component, such as an IC, mounted to the upper substrate surface and electrically connected to some of the contact pads. The support frame may include an upper edge sealed to an inner cover surface and a lower edge sealed to an upper substrate surface, where the inner cover surface and the upper substrate surface further define the first and second acoustic cavity volumes. The support frame may further comprise a cavity extending from the inner cover surface to the upper substrate surface, where the cavity is acoustically coupled to the second acoustic cavity volume. The audio transducer may be comprised of a microphone transducer, a MEMS microphone, a speaker transducer, or a MEMS speaker, and may be coupled via wire bonds to an electronic component (e.g., IC) mounted to the upper substrate surface. The substrate may be comprised of at least one layer of conductive material and at least one layer of non-conductive material, where the layer of substrate conductive material is electrically connected to a conductive material comprising the cover or a layer of the cover. The transducer package may further comprise a second acoustic port in acoustic communication with the second acoustic cavity volume, the second acoustic port located in either the cover or the substrate.

In at least one embodiment of the invention, a surface mountable transducer package is provided comprised of a microphone transducer; a substrate that includes a plurality of contact pads on the lower substrate surface; an integrated circuit mounted to the upper substrate surface and connected to the microphone transducer and the contact pads; a support frame comprised of a transducer mounting flange, a first recess within an upper portion of the support frame acoustically coupled to an upper transducer surface, a second recess within a lower portion of the support frame and acoustically coupled to a lower transducer surface, and a cavity extending through the support frame and acoustically coupled to the second recess; and a cover with an acoustic port and an inner cover surface sealed to an upper edge of the support frame, where a first acoustic cavity is defined by the first recess and a portion of the inner cover surface, and where a second acoustic cavity is defined by the second recess, the cavity, a second portion of the inner cover surface and the upper substrate surface. The substrate may be comprised of at least one layer of conductive material and at least one layer of non-conductive material, where the layer of substrate conductive material is electrically connected to a conductive material comprising the cover or a layer of the cover. The transducer package may further comprise a second acoustic port in acoustic communication with the second acoustic cavity volume, the second acoustic port located in either the cover or the substrate.

A further understanding of the nature and advantages of the present invention may be realized by reference to the remaining portions of the specification and the drawings.

DESCRIPTION OF THE SPECIFIC EMBODIMENTS

The present invention provides a surface mountable package for use with a transducer. Although preferably the transducer is an audio transducer, such as a microphone transducer or a speaker transducer, the present invention is not limited to audio transducers. For example, the invention can also be used with an ultrasonic transducer. As used herein, the term microphone will be understood to include microelectromechanical system (MEMS) microphones as well as other types of electric field type microphones. Similarly, the term speaker will be understood to include a MEMS speaker as well as all types of magnetic drivers. Lastly, identical element symbols used on multiple figures refer to the same component, or components of equal functionality. Additionally, the accompanying figures are only meant to illustrate, not limit, the scope of the invention and should not be considered to be to scale.

In addition to the audio transducer and associated electrical components, a surface mountable package, also referred to herein as a transducer package, in accordance with the invention includes three primary components; a substrate, an interior transducer support frame, and a cover. These three components are shown in the exploded, perspective view of FIG. 1. It should be understood that the embodiment shown in this and subsequent FIGS. 2-7 is only an exemplary embodiment of the invention and that other embodiments and configurations are clearly envisioned by the inventors. For example, and as described further below, the inventors envision other port arrangements as well as other acoustic cavity configurations.

Figure 1:
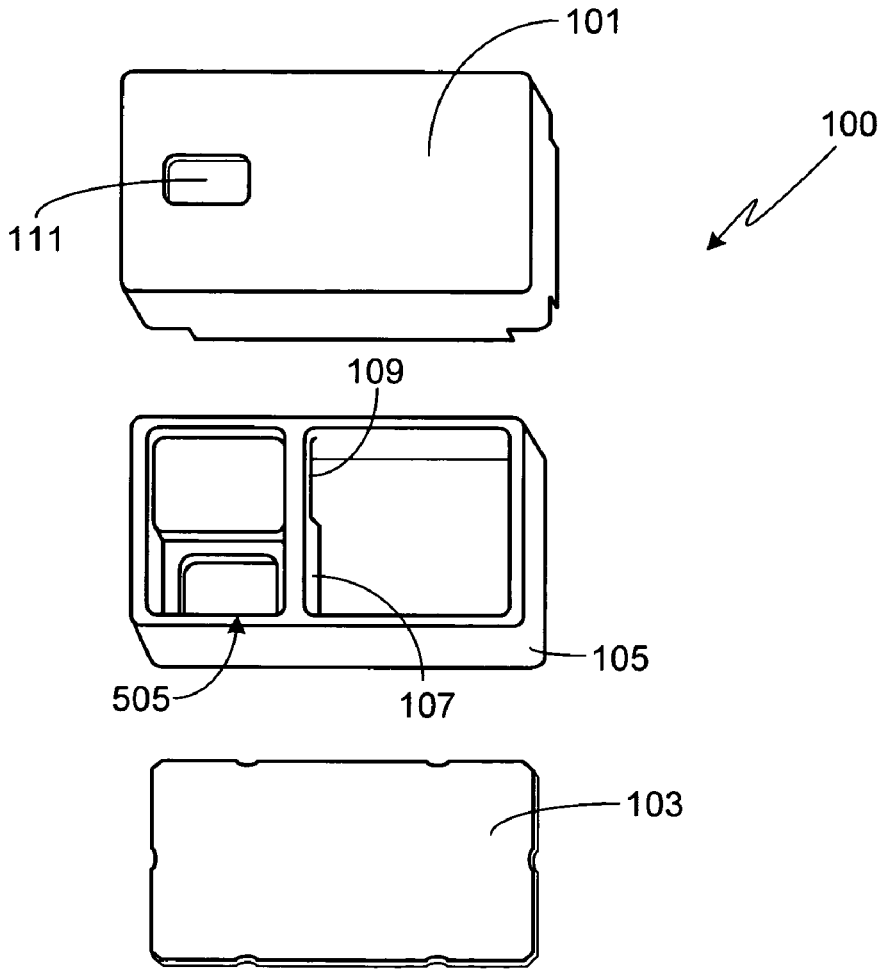
FIG. 1 provides an exploded, perspective view of a surface mountable transducer package in accordance with a preferred embodiment of the invention.
Figure 2:
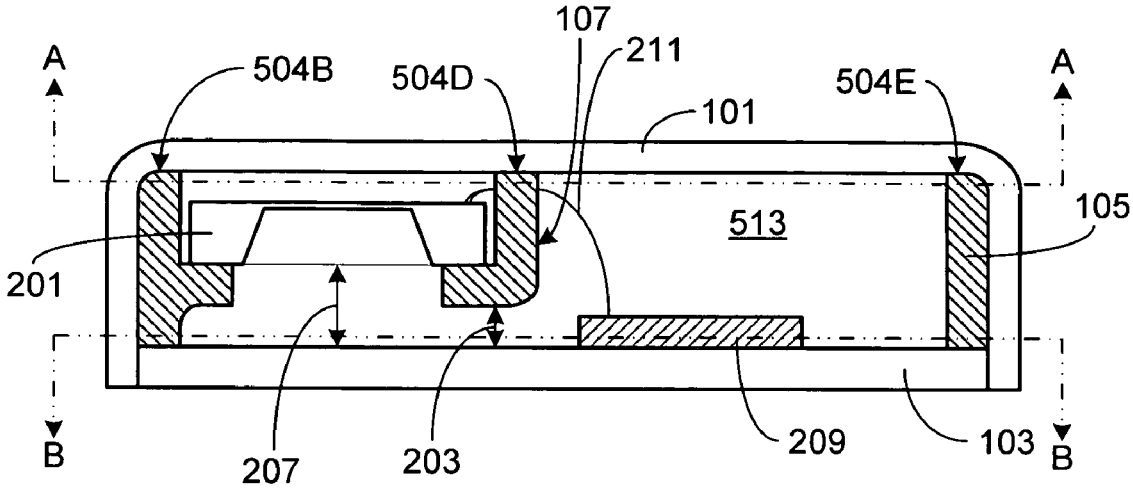
FIG. 2 is a length-wise, cross-sectional view of an assembled package in accordance with the embodiment shown in FIG. 1, this view taken through the transducer.
Figure 3:
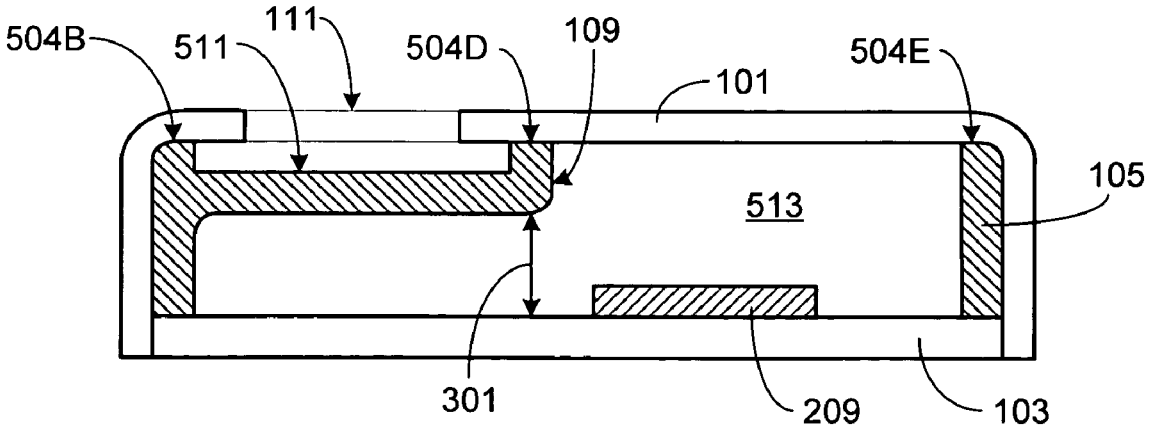
FIG. 3 is a length-wise, cross-sectional view of an assembled package in accordance with the embodiment shown in FIG. 1, this view taken through a region adjacent to the transducer.
Figure 4:
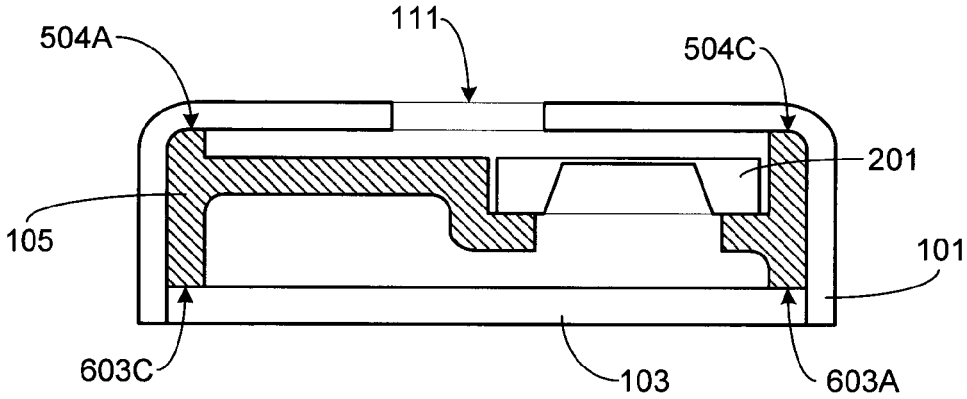
FIG. 4 is a cross-sectional view of the package assembly shown in FIGS. 1-3 taken at a right angle to the view of FIGS. 2 and 3 and through the transducer.
Figure 5:
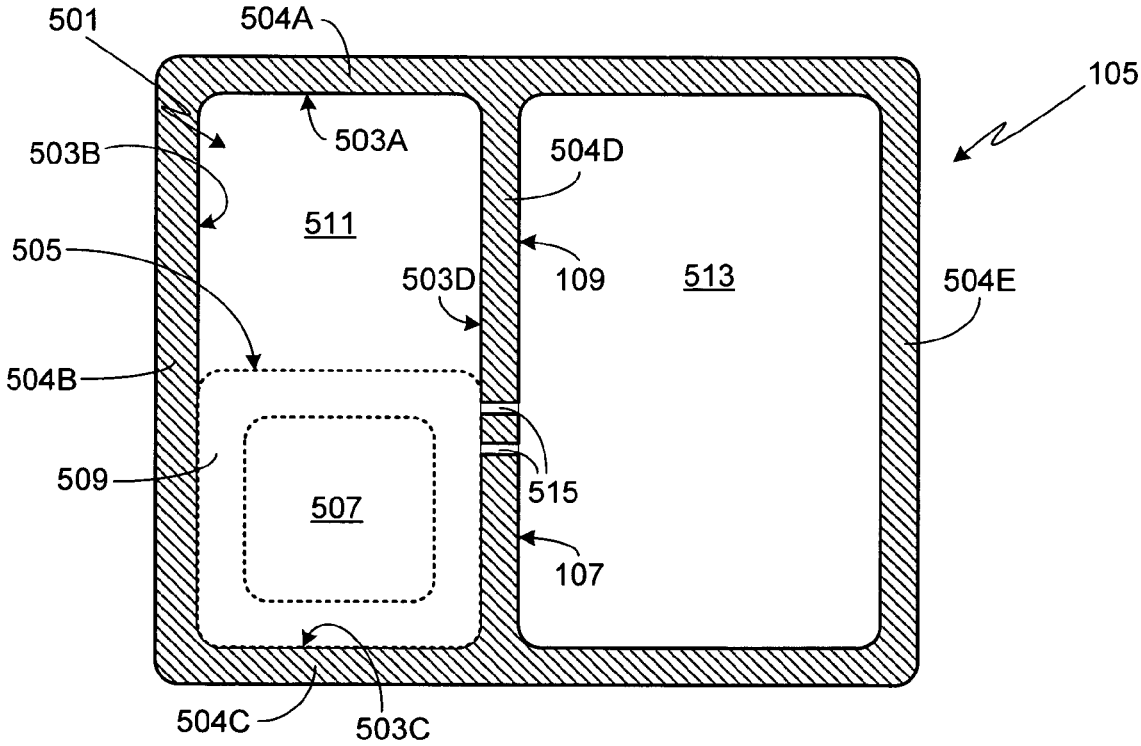
FIG. 5 is a top view of the support frame shown in FIGS. 1-4.
Figure 6:
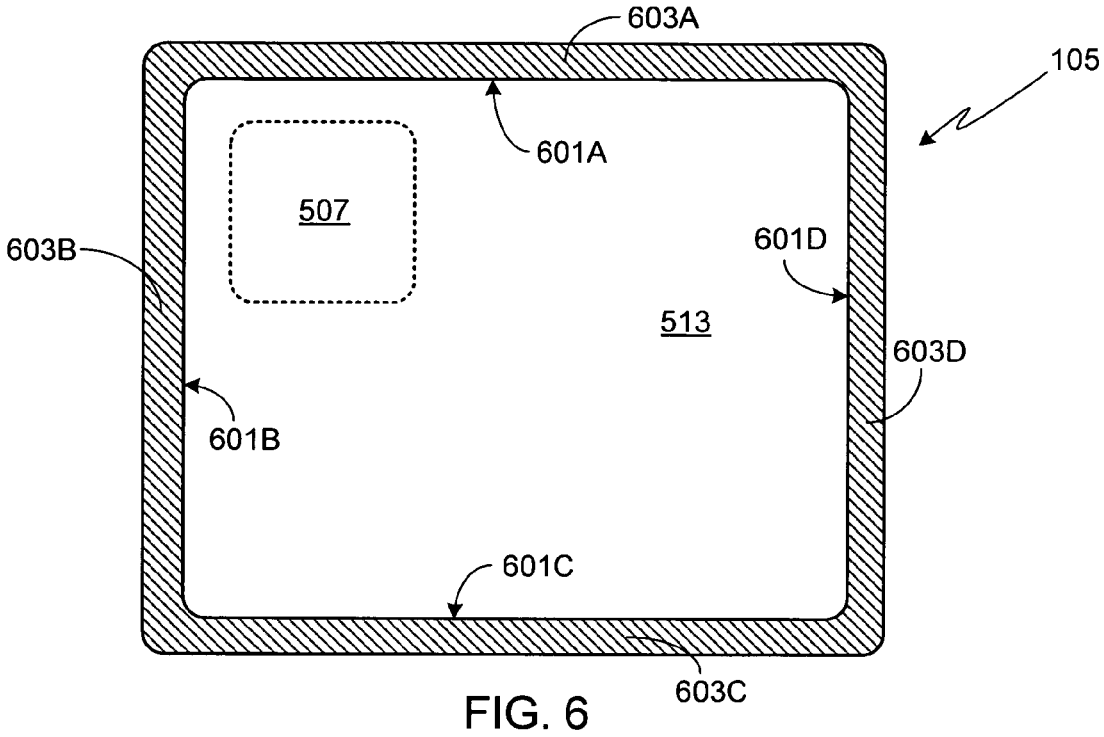
FIG. 6 is a bottom view of the support frame shown in FIGS. 1-4.

The three components of transducer package 100 shown in FIG. 1 are the cover 101, the substrate 103, and the support frame 105. Support frame 105 provides a mounting surface for the transducer and simplifies the design of both the front and rear acoustic cavity volumes. Further detail regarding support frame 105 is shown in FIGS. 2-6. FIGS. 2 and 3 provide length-wise, cross-sectional views of assembled package 100, the view shown in FIG. 2 taken along a plane through transducer 201 and the view shown in FIG. 3 taken along a plane through a region adjacent to transducer 201. FIG. 4 provides a cross-sectional view of assembled package 100 taken along a plane through transducer 201 and at a right angle to the views shown in FIGS. 2 and 3. FIG. 5 provides a top view of frame 105 taken along plane A-A of FIG. 2. FIG. 6 provides a bottom view of frame 105 taken along plane B-B of FIG. 2. Note that for the sake of clarity, the transducer mounting flange and the transducer aperture, described in detail below, are shown in phantom in FIG. 5. Similarly, the transducer aperture is also shown in phantom in FIG. 6.

Support frame member 105 is preferably comprised of an easily fabricated, mechanically and thermally robust material. For example, in a preferred embodiment support frame 105 is molded from a liquid crystal polymer (LCP), the selected material being very strong with good dimensional stability and melt flow and with heat resistance up to 340° C. An exemplary material is Vectra® S475, an LCP product of Ticona. Preferably support frame 105 is comprised of a single component fabricated from a single material, i.e., with no additional layers. Support frame member 105 is also preferably comprised of an electrically non-conductive material.

The top surface of support frame 105 includes a recessed portion 501 bounded by walls 503A-503D. Upper support frame edges 504A-504D, which coincide with walls 503A-503D, are configured to seal against the inner surface of cover 101 when package 100 is assembled, preferably resulting in an air-tight seal. To simplify fabrication and assembly, and as shown in the illustrations, the inner top surface of cover 101 is planar as are adjoining edges 504A-504D. Within recess 501 is a second recess 505. Recess 505 includes a central through-hole or aperture 507 along with an inner mounting lip or flange 509. Recess 505 and mounting flange 509 are configured to accept transducer 201, flange 509 supporting transducer 201 along its periphery. Preferably transducer 201 is a microelectromechanical system (MEMS) condenser microphone die, more preferably a silicon MEMS condenser microphone die, although recess 505, flange 509 and package 100 can be configured to accept other types of microphone and speaker transducers. In the exemplary embodiment, transducer 201 is mounted within recess 505 face up as shown. As such, the entire recess 501 comprises the front acoustic cavity volume of the transducer. The peripheral edge of transducer 201 is preferably bonded to flange 509 of recess 505, the adhesive bonding material forming an air-tight, acoustic seal that prevents leakage between the front and rear acoustic cavity volumes.

In the exemplary embodiment, the top face of transducer 201, when mounted within recess 505, is approximately coplanar with the surface 511 of recess 501. Additionally, there is no raised edge between recess 501 and the transducer, thus insuring that air flow within recess 501 is unimpeded. It should be appreciated that although the illustrated configuration is preferred, other configurations are possible. For example, surface 511 of recess 501 may be higher or lower than the top surface of transducer 201.

In addition to shaping the front acoustic cavity volume, the design of support frame 105 also shapes the rear acoustic cavity volume. In the exemplary embodiment, and as shown in FIG. 5, a portion 513 of support frame 105 is completely open thereby forming a cavity. The bottom view of member 105 shown in FIG. 6 as well as the cross-sectional views of FIGS. 2 and 3 illustrate that cavity 513 is directly coupled to the back surface of the transducer via gap 203 under wall portion 107 and gap 301 under wall portion 109. As illustrated, the rear acoustic cavity volume is bounded by transducer 201, cover 101, substrate 103, and support frame walls 601A-601D. Additionally, it will be appreciated that support frame walls 107/109 also bound the rear acoustic cavity, these walls separating the front and rear acoustic cavities as shown in the figures and described above.

In the preferred embodiment, neither wall portion 107 nor wall portion 109 extend down to substrate 103. It should be understood, however, that support frame 105 may be configured to allow a section of this wall to be in contact with substrate 103 as long as another section of the wall remains open, thereby coupling cavity 513 with the acoustic cavity volume directly beneath transducer 201. Preferably and as shown, wall section 107 adjacent to transducer mounting recess 505 extends further downward towards the substrate than adjacent wall section 109, thus increasing the rigidity of the portion of support frame 105 to which transducer 201 is mounted.

It will be appreciated that support frame 105 can be designed with various dimensions for recess 501 and cavity 513, thus allowing package 100 to be acoustically optimized for a particular application. Additionally, the dimensions of gaps 203 and 301 can be varied to control the coupling between cavity 513 and the portion of the rear acoustic cavity beneath transducer 201. Preferably the rear acoustic cavity volume is more than 2 times the volume of the front acoustic cavity, more preferably the rear acoustic cavity volume is more than 5 times the volume of the front acoustic cavity, and still more preferably the rear acoustic cavity volume is more than 7.5 times the volume of the front acoustic cavity. Note that in the preferred embodiment, gap height 203 is greater than 0.1 millimeters while the distance 207 between substrate 103 and the lowermost outline of transducer 201 is greater than 0.2 millimeters.

Substrate 103 provides a mounting surface for surface mounted electronic components, for example, an integrated circuit (IC) 209 that provides transducer signal amplification. Transducer 201 is coupled to IC 209 via wire-bonds 211. Preferably wire-bonds 211 are positioned within cut-outs 515 fabricated in edge 503D. These wire-bonds are sealed within cut-outs 515, thus insuring that after final assembly an air-tight seal is formed between recess 501, comprising the front acoustic cavity volume, and cavity 513, comprising a portion of the rear acoustic cavity volume.

Figure 7:
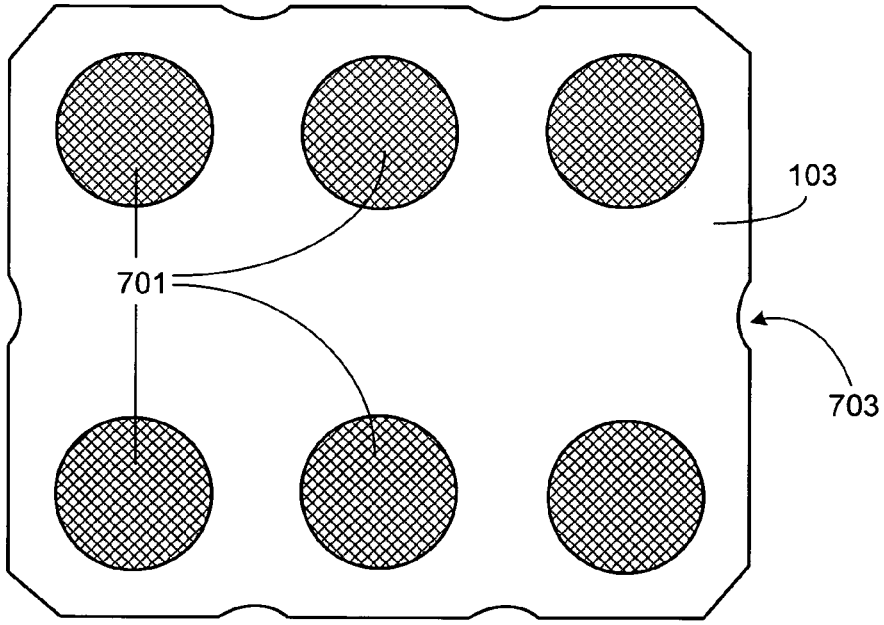
FIG. 7 is a bottom view of the substrate used in the transducer package assembly shown in FIGS. 1-4.

Substrate 103 is formed of a glass-epoxy type PCB laminate such as FR-4 or similar material, thus providing a transducer package assembly that has a thermal coefficient of expansion that closely matches that of a typical PCB to which assembly 100 is likely to be attached by an end user. Additionally, the use of FR-4 or similar material lends itself to large batch processing using well known panel fabrication techniques. The bottom surface of substrate 103, as shown in FIG. 7, includes a plurality of contact pads 701, also commonly referred to as solder pads or terminal pads. Contact pads 701 are used to attach transducer assembly 100 to the intended application, for example the PCB of a telephone headset. In at least one embodiment, contact pads 701 are comprised of copper. Contact pads 701 may be coupled to IC 209 using plated substrate through-holes, copper traces, wire bonds, or other means or combinations well known by those of skill in the art. It will be appreciated that substrate 103 may be comprised of a single layer or multiple layers as preferred, for example using alternating layers of non-electrically conductive material (e.g., FR-4) and electrically conductive material (e.g., copper), the multi-layer configuration providing a convenient means for signal routing for use with some embodiments. Additionally, the use of at least one electrically conductive layer within substrate 103 covering a substantial portion of the substrate area, along with a conductive cover 101 as described below, provides an effective shield against electromagnetic interference.

The peripheral lower edge 603A-603D of support frame 105 is bonded to substrate 103 as shown. Preferably the adhesive used to form this bond provides an air-tight, acoustic seal, thus preventing leakage between the rear acoustic cavity volume and the ambient environment.

Cover 101 includes at least one acoustic port 111. Preferably acoustic port 111 is not located directly above audio transducer recess 505, and thus not directly above transducer 201 after package assembly. Displacing acoustic port 111 relative to transducer 201 provides additional protection to the transducer during manufacturing, handling, installation and operation. As shown in FIGS. 1, 3, and 4, acoustic port 111 is located above recess 501, but offset from above the portion of recess 501 in which recess 505 is located.

Cover 101 may be fabricated from any of a variety of materials, and may be comprised of a single material or multiple materials. Although not required, preferably cover 101 is designed to provide shielding against electromagnetic interference. As such, either the material comprising cover 101, or the material comprising a coating or layer of cover 101, is conductive and electrically connected to the conductive layer within substrate 103. Exemplary materials for cover 101 include a metal (e.g., steel, tin-plated steel, copper, aluminum, tin- or copper-plated aluminum, etc.), a conductive plastic or composite (e.g., a polymer that has been doped, embedded, or otherwise formed such that it contains a conductive material such as carbon powder/fibers, metallic powder, etc.), or a non-conductive material (e.g., plastic) that has been coated with a conductive material.

During assembly, and after attaching support frame 105 to substrate 103, cover 101 is coupled to both support frame 105 and substrate 103. In this process, edges 504A-504E of support frame 105 are sealed to the inner surface of cover 101, for example using an adhesive sealant, thereby insuring that the front and rear acoustic cavities remain separate and air-tight, and not leaky to the ambient. Additionally, the conductive element of cover 101 is electrically connected to the conductive layer of substrate 103, for example by soldering a metallic substrate edge corresponding to substrate 103 to the conductive cover or conductive coating of cover 101. In at least one embodiment, substrate 103 includes a plurality of solder paste cutouts 703 that allow the conductive elements of substrate 103 and cover 101 to be soldered together, for example using an IR reflow process, thereby achieving both electrical and structural coupling of the two members. In at least one alternate embodiment, cover 101 may overhang the substrate and be mechanically bent or crimped about the lower surface of substrate 103 to provide electrical and structural coupling. It should be appreciated that while the coupling means provided in the above embodiments are preferred, other means to electrically and structurally couple the cover to the substrate are clearly envisioned by the inventors.

Figure 8:
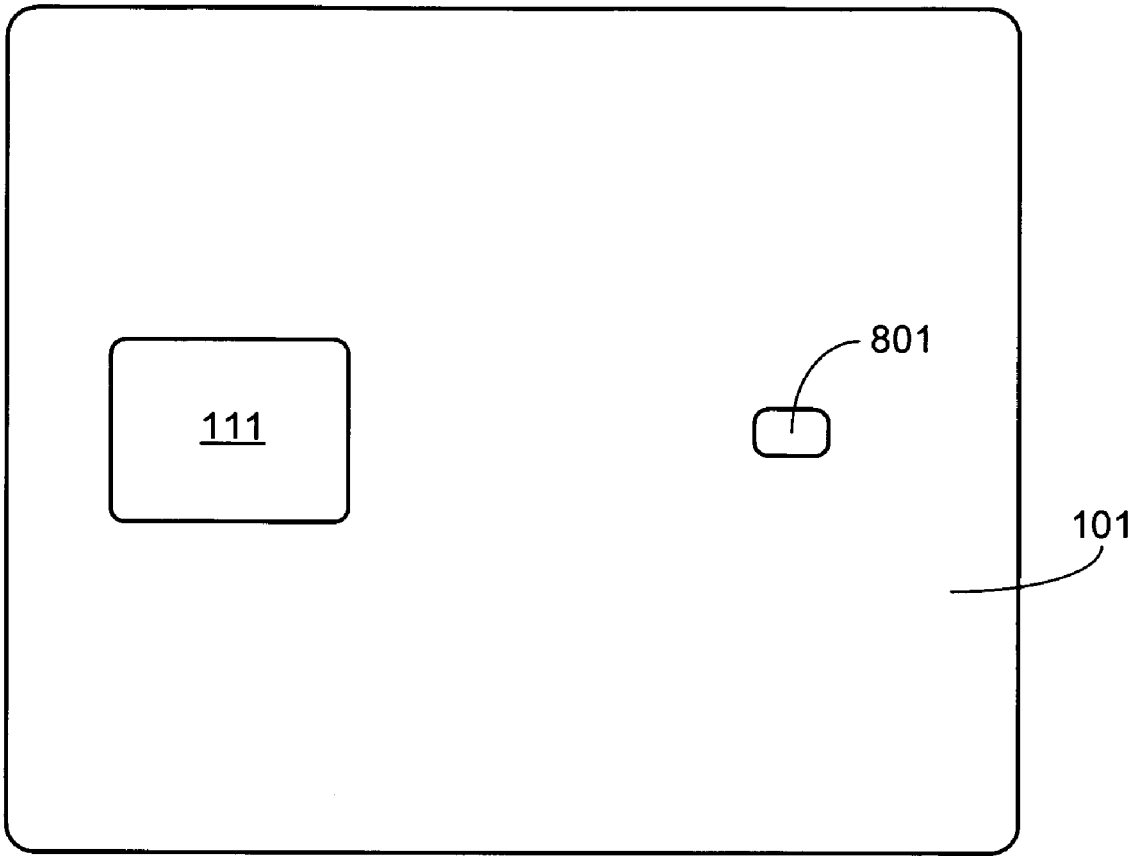
FIG. 8 is a top view of a transducer package assembly cover according to an alternate embodiment.

It will also be appreciated that a transducer package in accordance with the invention can utilize more ports, and/or different port locations, than that shown in FIGS. 1, 3, and 4, and as described above. For example, instead of including a port in cover 101, the acoustic port can be located in substrate 103. It will be appreciated that in order to take full advantage of a substrate port, the end-user product's PCB or other component to which the transducer package is mounted must include a complimentary port. Alternately, and as illustrated in FIG. 8, the assembly can include port 111 plus a second acoustic port 801 added to cover 101, acoustic port 801 located above cavity 513. By providing a second acoustic port coupled to the rear acoustic cavity volume, an omnidirectional type microphone may be converted to a gradient-type directional or noise-canceling microphone. Alternately, the second acoustic port may be located in substrate 103.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention.

What is claimed is:

1. A transducer package, comprising:

an audio transducer;

a substrate with an upper substrate surface and a lower substrate surface, wherein said lower substrate surface further comprises a plurality of contact pads;

a support frame attached to said substrate and comprising an audio transducer mounting flange and an acoustic aperture located within said audio transducer mounting flange, said audio transducer mounted to said audio transducer mounting flange, said support frame defining at least a first acoustic cavity volume in acoustic communication with an upper surface of said audio transducer and a second acoustic cavity volume in acoustic communication with a lower surface of said audio transducer; and a cover attached to said substrate and to said support frame, said cover comprising an acoustic port in acoustic communication with said first acoustic cavity volume, wherein said support frame further comprises an upper edge sealed to an inner surface of said cover, and a lower edge sealed to said upper substrate surface, wherein said first acoustic cavity volume is further defined by said inner surface of said cover, and wherein said second acoustic cavity volume is further defined by said upper substrate surface.

2. The transducer package of claim 1, further comprising at least one electronic component mounted to said upper substrate surface, wherein said audio transducer is electrically connected to said at least one electronic component, and wherein said at least one electronic component is electrically connected to at least some of said plurality of contact pads.

3. The transducer package of claim 2, wherein said audio transducer is electrically connected to said at least one electronic component via wire bonds.

4. The transducer package of claim 2, wherein said at least one electronic component is an integrated circuit (IC).

5. A transducer package, comprising:

an audio transducer;

a substrate with an upper substrate surface and a lower substrate surface, wherein said lower substrate surface further comprises a plurality of contact pads;

a support frame attached to said substrate and comprising an audio transducer mounting flange and an acoustic aperture located within said audio transducer mounting flange, said audio transducer mounted to said audio transducer mounting flange, said support frame defining at least a first acoustic cavity volume in acoustic communication with an upper surface of said audio transducer and a second acoustic cavity volume in acoustic communication with a lower surface of said audio transducer; and a cover attached to said substrate and to said support frame, said cover comprising an acoustic port in acoustic communication with said first acoustic cavity volume, wherein said support frame further comprises a cavity extending from an inner surface of said cover through said support frame and to said upper substrate surface, wherein said cavity is in acoustic communication with said second acoustic cavity volume.

6. The transducer package of claim 5, wherein said support frame further comprises an upper edge sealed to said inner surface of said cover, and a lower edge sealed to said upper substrate surface, wherein said first acoustic cavity volume is further defined by said inner surface of said cover, and wherein said second acoustic cavity volume and said cavity in acoustic communication with said second acoustic cavity volume are further defined by said upper substrate surface and said inner surface of said cover.

7. The transducer package of claim 1, wherein said audio transducer is sealed to said audio transducer mounting flange, and wherein said first acoustic cavity volume is acoustically isolated from said second acoustic cavity volume.

8. The transducer package of claim 1, wherein said audio transducer is a microphone transducer.

9. The transducer package of claim 1, wherein said audio transducer is a MEMS microphone.

10. The transducer package of claim 1, wherein said audio transducer is a speaker transducer.

11. The transducer package of claim 1, wherein said audio transducer is a MEMS speaker.

12. The transducer package of claim 1, wherein said acoustic port is offset and not overlapping with said audio transducer.

13. The transducer package of claim 1, wherein said substrate is comprised of at least one layer of electrically conductive material and at least one layer of non-electrically conductive material, wherein said cover is comprised of an electrically conductive material, and wherein said at least one layer of electrically conductive material of said substrate is electrically connected to said electrically conductive material of said cover.

14. The transducer package of claim 1, wherein said substrate is comprised of at least one layer of electrically conductive material and at least one layer of non-electrically conductive material, wherein said cover is comprised of an electrically conductive coating, and wherein said at least one layer of electrically conductive material of said substrate is electrically connected to said electrically conductive coating of said cover.

15. A transducer package, comprising:

an audio transducer;

a substrate with an upper substrate surface and a lower substrate surface, wherein said lower substrate surface further comprises a plurality of contact pads;

a support frame attached to said substrate and comprising an audio transducer mounting flange and an acoustic aperture located within said audio transducer mounting flange, said audio transducer mounted to said audio transducer mounting flange, said support frame defining at least a first acoustic cavity volume in acoustic communication with an upper surface of said audio transducer and a second acoustic cavity volume in acoustic communication with a lower surface of said audio transducer; and a cover attached to said substrate and to said support frame, said cover comprising an acoustic port in acoustic communication with said first acoustic cavity volume, wherein said cover further comprises a second acoustic port in acoustic communication with said second acoustic cavity volume.

16. The transducer package of claim 1, wherein said substrate further comprises a substrate acoustic port in acoustic communication with said second acoustic cavity volume.

17. A transducer package, comprising:

an audio transducer;

a substrate with an upper substrate surface and a lower substrate surface, wherein said lower substrate surface further comprises a plurality of contact pads;

a support frame attached to said substrate and comprising an audio transducer mounting flange and an acoustic aperture located within said audio transducer mounting flange, said audio transducer mounted to said audio transducer mounting flange, said support frame defining at least a first acoustic cavity volume in acoustic communication with an upper surface of said audio transducer and a second acoustic cavity volume in acoustic communication with a lower surface of said audio transducer, and wherein said support frame is solely comprised of non-electrically conductive material; and a cover attached to said substrate and to said support frame, said cover comprising an acoustic port in acoustic communication with said first acoustic cavity volume.

18. The transducer package of claim 1, wherein said first acoustic cavity volume defines a front acoustic cavity volume, wherein said second acoustic cavity volume defines a rear acoustic cavity volume, and wherein said rear acoustic cavity volume is at least 2 times as large as said front acoustic cavity volume.

19. The transducer package of claim 1, wherein said first acoustic cavity volume defines a front acoustic cavity volume, wherein said second acoustic cavity volume defines a rear acoustic cavity volume, and wherein said rear acoustic cavity volume is at least 5 times as large as said front acoustic cavity volume.

20. The transducer package of claim 1, wherein said first acoustic cavity volume defines a front acoustic cavity volume, wherein said second acoustic cavity volume defines a rear acoustic cavity volume, and wherein said rear acoustic cavity volume is at least 7.5 times as large as said front acoustic cavity volume.

21. A surface mountable transducer package, comprising:

a microphone transducer;

a substrate with an upper substrate surface and a lower substrate surface, wherein said lower substrate surface further comprises a plurality of contact pads;

an integrated circuit (IC) mounted to said upper substrate surface, wherein said IC is electrically connected to at least some of said plurality of contact pads;

a support frame comprising:

a transducer mounting flange and an acoustic aperture located within said transducer mounting flange, wherein said microphone transducer is sealed to said transducer mounting flange, and wherein said microphone transducer is electrically connected to said IC;

a first recess within an upper portion of said support frame, wherein said transducer mounting flange and said microphone transducer are positioned within said first recess, and wherein said first recess is acoustically coupled to a first surface of said microphone transducer;

a second recess within a lower portion of said support frame, wherein said second recess is acoustically coupled to a second surface of said microphone transducer; and a cavity extending through said support frame and acoustically coupled to said second recess; and a cover comprising:

an inner cover surface sealed to an upper edge of said support frame, wherein a first acoustic cavity volume is defined by said first recess and a first portion of said inner cover surface, and wherein a second acoustic cavity volume is defined by said second recess, said cavity, a second portion of said inner cover surface, and said upper substrate surface; and an acoustic port in acoustic communication with said first acoustic cavity volume.

22. The surface mountable transducer package of claim 21, wherein said substrate is comprised of at least one layer of electrically conductive material and at least one layer of non-electrically conductive material, wherein said cover is comprised of at least one layer of electrically conductive material, and wherein said at least one layer of electrically conductive material of said substrate is electrically connected to said at least one layer of electrically conductive material of said cover.

23. The surface mountable transducer package of claim 21, wherein said substrate further comprises a substrate acoustic port in acoustic communication with said second acoustic cavity volume.

24. The surface mountable transducer package of claim 21, wherein said cover further comprises a second acoustic port in acoustic communication with said second acoustic cavity volume.

25. The transducer package of claim 21, wherein said first acoustic cavity volume defines a front acoustic cavity volume, wherein said second acoustic cavity volume defines a rear acoustic cavity volume, and wherein said rear acoustic cavity volume is at least 2 times as large as said front acoustic cavity volume.

26. The transducer package of claim 21, wherein said first acoustic cavity volume defines a front acoustic cavity volume, wherein said second acoustic cavity volume defines a rear acoustic cavity volume, and wherein said rear acoustic cavity volume is at least 5 times as large as said front acoustic cavity volume.

27. The transducer package of claim 21, wherein said first acoustic cavity volume defines a front acoustic cavity volume, wherein said second acoustic cavity volume defines a rear acoustic cavity volume, and wherein said rear acoustic cavity volume is at least 7.5 times as large as said front acoustic cavity volume.

28. The transducer package of claim 17, further comprising at least one electronic component mounted to said upper substrate surface, wherein said audio transducer is electrically connected to said at least one electronic component, and wherein said at least one electronic component is electrically connected to at least some of said plurality of contact pads.

29. The transducer package of claim 28, wherein said audio transducer is electrically connected to said at least one electronic component via wire bonds.

30. The transducer package of claim 28, wherein said at least one electronic component is an integrated circuit (IC).

31. The transducer package of claim 17, wherein said audio transducer is sealed to said audio transducer mounting flange, and wherein said first acoustic cavity volume is acoustically isolated from said second acoustic cavity volume.

32. The transducer package of claim 17, wherein said audio transducer is a microphone transducer.

33. The transducer package of claim 17, wherein said audio transducer is a MEMS microphone.

34. The transducer package of claim 17, wherein said audio transducer is a speaker transducer.

35. The transducer package of claim 17, wherein said audio transducer is a MEMS speaker.

36. The transducer package of claim 17, wherein said acoustic port is offset and not overlapping with said audio transducer.

37. The transducer package of claim 17, wherein said substrate is comprised of at least one layer of electrically conductive material and at least one layer of non-electrically conductive material, wherein said cover is comprised of an electrically conductive material, and wherein said at least one layer of electrically conductive material of said substrate is electrically connected to said electrically conductive material of said cover.

38. The transducer package of claim 17, wherein said substrate is comprised of at least one layer of electrically conductive material and at least one layer of non-electrically conductive material, wherein said cover is comprised of an electrically conductive coating, and wherein said at least one layer of electrically conductive material of said substrate is electrically connected to said electrically conductive coating of said cover.

39. The transducer package of claim 17, wherein said substrate further comprises a substrate acoustic port in acoustic communication with said second acoustic cavity volume.

40. The transducer package of claim 17, wherein said first acoustic cavity volume defines a front acoustic cavity volume, wherein said second acoustic cavity volume defines a rear acoustic cavity volume, and wherein said rear acoustic cavity volume is at least 2 times as large as said front acoustic cavity volume.

* * * * *